US008209884B2

(12) United States Patent
McClaskie

(10) Patent No.: US 8,209,884 B2
(45) Date of Patent: Jul. 3, 2012

(54) OUTSIDE OPANKA SHOE CONSTRUCTION

(75) Inventor: Thomas E. McClaskie, Bethlehem, PA (US)

(73) Assignee: Columbia Insurance Company, Omaha, NE (US)

( * ) Notice: Subject to any disclaimer, the term of this patent is extended or adjusted under 35 U.S.C. 154(b) by 439 days.

(21) Appl. No.: 12/488,221

(22) Filed: Jun. 19, 2009

(65) Prior Publication Data

US 2010/0319221 A1 Dec. 23, 2010

(51) Int. Cl.
*A43B 9/02* (2006.01)

(52) U.S. Cl. ..... 36/18; 36/21; 12/142 C

(58) Field of Classification Search ..... 36/18, 21, 36/23, 16, 12; 12/142 C, 142 B
See application file for complete search history.

(56) References Cited

U.S. PATENT DOCUMENTS

| | | | | | |
|---|---|---|---|---|---|
| 2,771,691 | A | * | 11/1956 | Luchs | 36/10 |
| 3,289,328 | A | * | 12/1966 | Abel | 36/9 R |
| 3,629,961 | A | | 12/1971 | Sief | |
| 4,150,498 | A | * | 4/1979 | Palmer | 36/10 |
| 4,505,055 | A | * | 3/1985 | Bergmans | 36/18 |
| 5,499,459 | A | * | 3/1996 | Tomaro | 36/10 |
| 5,802,742 | A | * | 9/1998 | Baude et al. | 36/117.6 |
| 6,978,559 | B2 | | 12/2005 | Chu et al. | |
| 7,322,128 | B2 | | 1/2008 | Issler | |
| 2005/0172514 | A1 | | 8/2005 | Wu | |
| 2009/0031582 | A1 | | 2/2009 | Lu | |

* cited by examiner

*Primary Examiner* — Ted Kavanaugh
(74) *Attorney, Agent, or Firm* — St. Onge Steward Johnston & Reens LLC

(57) ABSTRACT

A shoe construction and a method for making a shoe wherein an outsole is provided with a raised lip extending around a periphery of the outsole, and an upper is secured to the outsole by a stitch along the lip such that an inside surface of the upper is facing the outside surface of the lip. The shoe construction further includes an inner sole and a vamp lining secured together by a stitch and placed on the inside surface of the upper such as to protect a wearer's foot from the stitch securing the outsole with the upper.

18 Claims, 5 Drawing Sheets

OUTSIDE OPANKA SHOE CONSTRUCTION

FIELD OF THE INVENTION

The invention relates to a shoe having an improved shoe construction, and in particular to a shoe having an outsole sewn to an upper by means of stitching, and having a vamp lining to protect a wearer's foot from the stitching.

BACKGROUND OF THE INVENTION

A variety of different sole constructions are used by the footwear industry. For the most part, each sole construction has characteristics that make it particularly well-suited for specific applications. For example, some sole constructions are selected for their durability, others for their flexibility and comfort, while still others are selected for their aesthetic appeal.

One well-known construction method, known as a welt construction, typically includes a strip of material such as leather or hard rubber that is used to secure the shoe sole and the shoe upper together. Welt construction typically involves a number of manufacturing steps. First, the upper is wrapped around a last and secured to the insole by stitching, stapling or other securing mechanism. Once the upper is lasted, a welt is usually secured to the upper and insole by stitching. The midsole may also be secured to the bottom of the upper/insole assembly by stitching that extends through the base portion of the welt and the midsole. Although this type of shoe construction provides a certain degree of durability and aesthetic appeal, it usually requires numerous manufacturing steps and thus increased costs of production. The other problems associated with this type of shoe construction are heaviness and decreased flexibility of the shoe.

It is also known to cement components of a shoe together, such as an upper to an outsole. Typically, this process involves numerous manufacturing steps. First, the surfaces to be cemented, or glued, need to be cleaned and readied, which may also include roughening. Further, there may be an application step where the cement is applied to the surfaces, which further involves measuring and evenly distributing the glue over the surface. Further, there may be a pressing step where the surfaces are pressed together in order to reduce air that may be trapped between the surfaces and enhances adhesion. Once the components are pressed together, cementing often requires a waiting period for the cement to dry. Thus, one of the problems with the cementing process is the number of steps and time involved, which in turn negatively affects cost and efficiency. Additionally, the cementing process may be further complicated if the surfaces to be glued are uneven or difficult to reach.

Another known type of shoe construction is an Opanka construction, wherein the outsole of the shoe is typically sewed to the upper of the shoe along an outer periphery of the outsole. An example of Opanka construction is described in U.S. Pat. No. 7,322,128 to Issler. FIG. 1 shows a shoe 10 having an upper 11 that is secured to the outsole 12 by a stitch 13 in the fore part of the shoe 10. The stitch passes through the upper 11 into a first channel 14 on the outsole 12, and then into a second channel 15 on the outsole 12. It is apparent that this type of construction or stitching produces two rows of visible stitching: an upper row is formed in the first channel 14 and a lower row is formed in the second channel 15. In the rear part of the shoe 10, as shown in FIG. 2, a different type of the stitch 18 is used, which passes the thread through the outsole 12, the upper 11, and a liner 19. The shoe 10 further includes a sockliner 20 sewn to the liner 19 within the shoe upper 11.

However, there are several problems associated with this type of construction. First, having an outsole that shows two rows of stitching may detract from the appearance of the shoe. Second, the lower row of stitching is more likely to be damaged by walking, and such damage could cause the shoe to fall apart. The two rows of stitching make the shoe less durable.

Similar problems are also present in other known types of shoe constructions. For example, U.S. Pat. No. 4,505,055 to Bergmans discloses a shoe structure wherein the outsole has a sidewall that extends around its circumference. The lip has a vertical outer face and a ledge that projects horizontally. The upper rests on the ledge, and stitching extends through the upper and the lip. However, the stitching also extends through an insole and is exposed on the interior of the shoe. Such a design leads to discomfort to the wearer, since the wearer's foot will rub against the stitching.

U.S. Application Serial No. 2005/0172514 to Wu discloses a shoe construction in which the outsole includes a barrier wall that extends around the periphery of the shoe. The upper is attached to the outsole by stitching that extends through the outer periphery of the upper into a channel formed by the barrier wall and out of the side surface of the outsole. Thus, the construction requires two rows of stitching that are visible on the outside of the shoe, which decreases the aesthetic appeal and the durability of the shoe.

What is needed, therefore, is an improved shoe construction technique by which a shoe may be constructed in a more efficient manner, and by which manufacturing costs are reduced and that involves fewer manufacturing operations. Another desire is to provide a shoe wherein the stitching used for securing the outsole to the upper is only minimally visible on the outside of the shoe to enhance aesthetics. Yet a further desire is to provide a shoe that is comfortable to wear and that protects a wearer's foot from uncomfortable contact with stitching.

SUMMARY OF THE INVENTION

It is, therefore, an object of the invention to provide a shoe having improved construction and reduced manufacturing costs.

Another object is to provide a shoe with a simple construction and improved aesthetic appearance without sacrificing structural integrity.

Yet another object is to provide a shoe that offers better protection and comfort to a wearer.

In order to achieve at least the above-mentioned objects of the present invention, according to a first embodiment of the invention, a shoe is provided comprising an outsole having a toe area and a raised lip extending around a periphery of the outsole, the lip having an inside surface and an outside surface; an upper having an inside surface and an outside surface; an inner sole; and a vamp lining secured to the inner sole by a first stitch. The upper is secured to the outsole by a second stitch extending around at least the toe area of the outsole such that the inside surface of the upper is facing the outside surface of the lip. The second stitch extends through the outside surface of the upper, through the inside surface of the upper, through the outside surface of the lip, and through the inside surface of the lip. The inner sole and the vamp lining are adjacent to the inside surface of the upper to cover the second stitch and to provide protection for a wearer's foot.

In some embodiments, the inner sole and the vamp lining are moveable with respect to the upper and the outsole in the toe area of the outsole. In some embodiments, the second stitch extends around the entire periphery of the outsole. In certain embodiments, the inner sole covers only the toe area of the outsole.

In some embodiments, the shoe further includes a shelf formed adjacent to the lip on said outside surface of the lip, wherein the shelf has a width corresponding to a thickness of the upper so that when the upper is stitched to the lip, the outside surface of the upper is substantially flush with an outside surface of the outsole. In some embodiments, the second stitch is an Opanka stitch or a hand-sewn stitch.

In some embodiments, the shoe also includes a cushion material between the vamp lining and the inside surface of the upper. In some embodiments, an insert is removably placed on the inner sole for cushioning the wearer's foot.

In a further embodiment of the invention, a method for constructing a shoe includes the steps of providing an outsole having a toe area and a raised lip that extends around a periphery of the outsole; providing an upper having an inside surface and an outside surface; providing an inner sole; securing a vamp lining to the inner sole by a first stitch; placing the upper adjacent to the outsole such that the inside surface of the upper is facing an outside surface of the lip; securing the upper to the outsole along the entire periphery of the outsole by a second stitch, where the second stitch is formed by passing a stitch material through the outside surface of the upper, through the inside surface of the upper, through the outside surface of the lip, and through the inside surface of the lip; and placing the inner sole and the vamp lining adjacent to the inside surface of the upper such that the inner sole and the vamp lining cover he second stitch and provide protection for a wearer's foot.

In some embodiments, the inner sole and the vamp lining are moveable with respect to the upper and the outsole in the toe area of the outsole.

In some embodiments, a cushion is provided between the vamp lining and the inside surface of the upper. In some embodiments, an insert is removably placed on the inner sole for cushioning the wearer's foot. In some embodiments, the inner sole is provided only in a fore portion of the outsole.

In some embodiments, the upper is secured to the outsole by an Opanka stitch or by a hand-sewn stitch.

In some embodiments, the method includes the step of providing a shelf on the outside surface of the lip and the shelf having a width corresponding to a thickness of the upper. In some embodiments, the upper is stitched to the lip such that the outside surface of the upper is substantially flush with an outside surface of the outsole.

In certain embodiments, the second stitch is extended from the outside surface of the upper, through the inside surface of the upper, through the outside surface of the lip, and to the inside surface of the lip.

The invention and its particular features and advantages will become more apparent from the following detailed description considered with reference to the accompanying drawings.

DETAILED DESCRIPTION OF THE INVENTION

Figure 1:
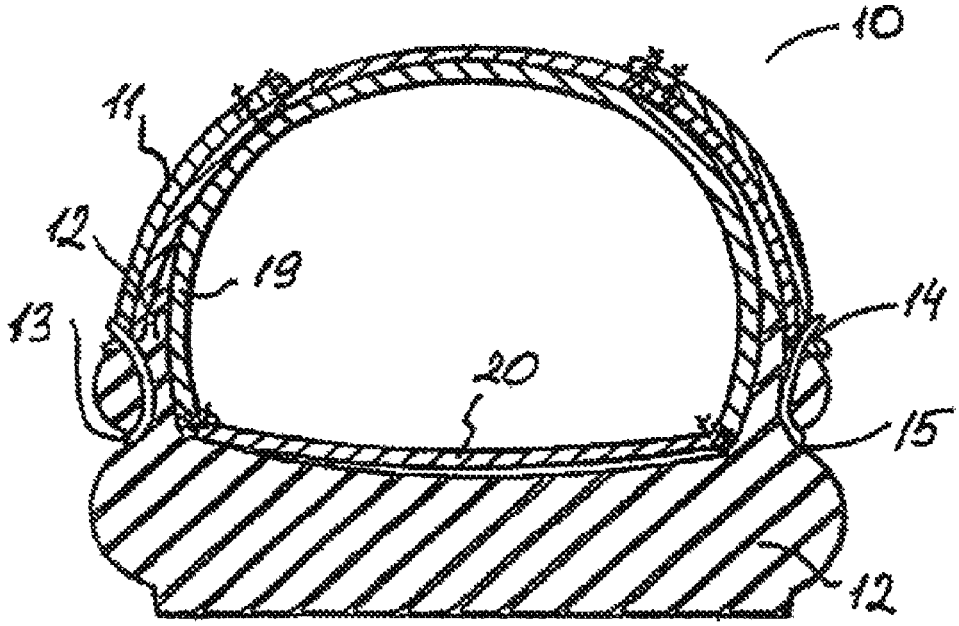
FIG. 1 Prior Art
FIG. 1 illustrates a prior art shoe construction.
Figure 2:
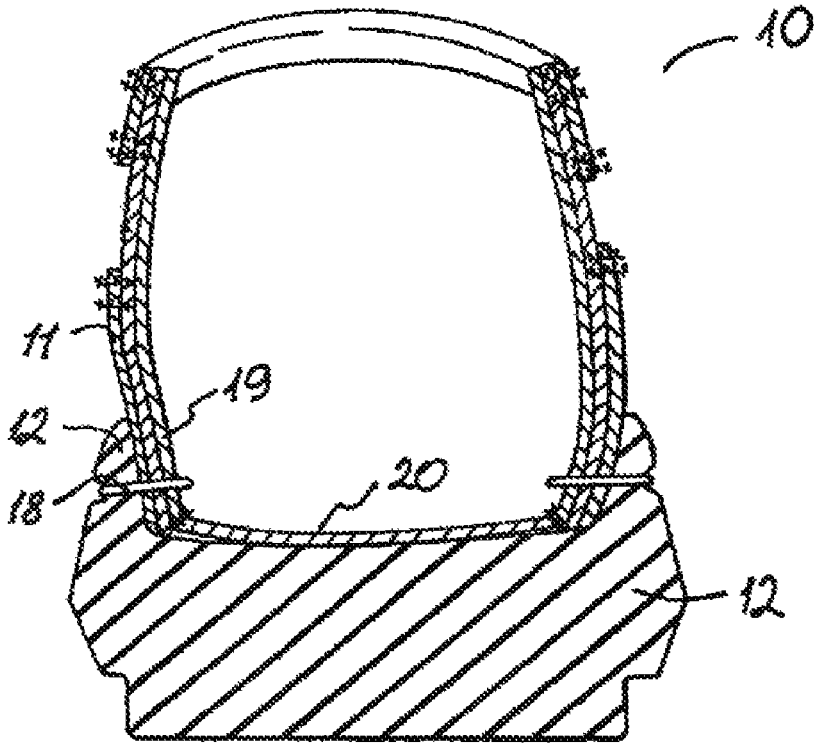
FIG. 2 Prior Art
FIG. 2 illustrates another prior art shoe construction.
Figure 3:
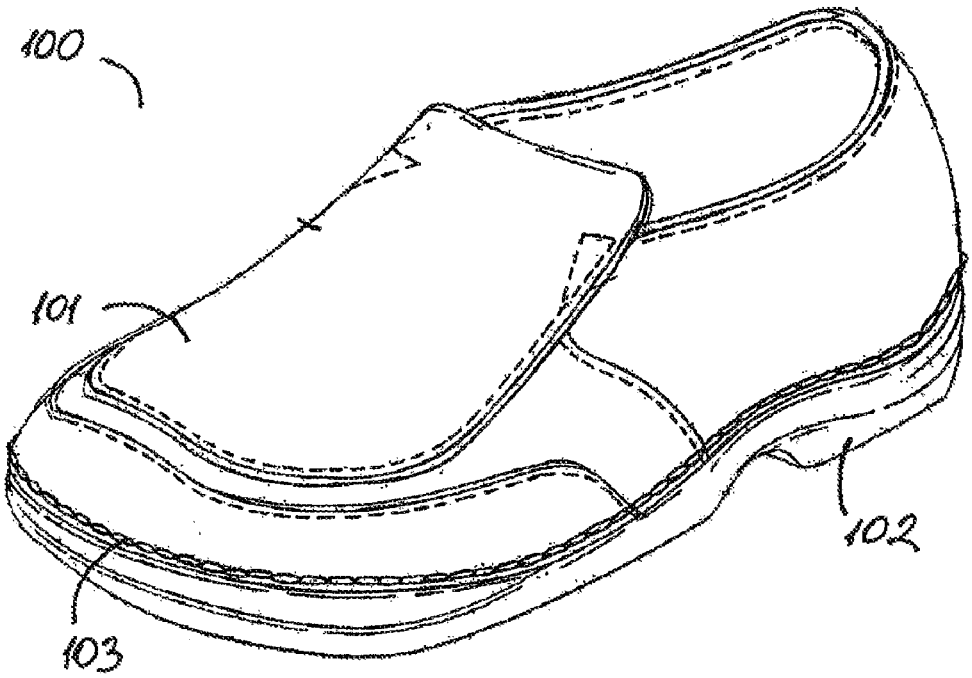
FIG. 3 is a perspective view of a shoe constructed in accordance with the present invention.

Embodiments of the present invention will now be described with reference to FIGS. 3-8. FIG. 3 shows a shoe 100 constructed in accordance with the present invention. The shoe 100 includes an upper 101, an outsole 102, and a stitch 103 that secures the upper 101 to the outsole 102. The shoe 100 can generally be characterized as having an Opanka construction, as the outsole 102 and the upper 101 are sewed directly to one another.

Figure 4:
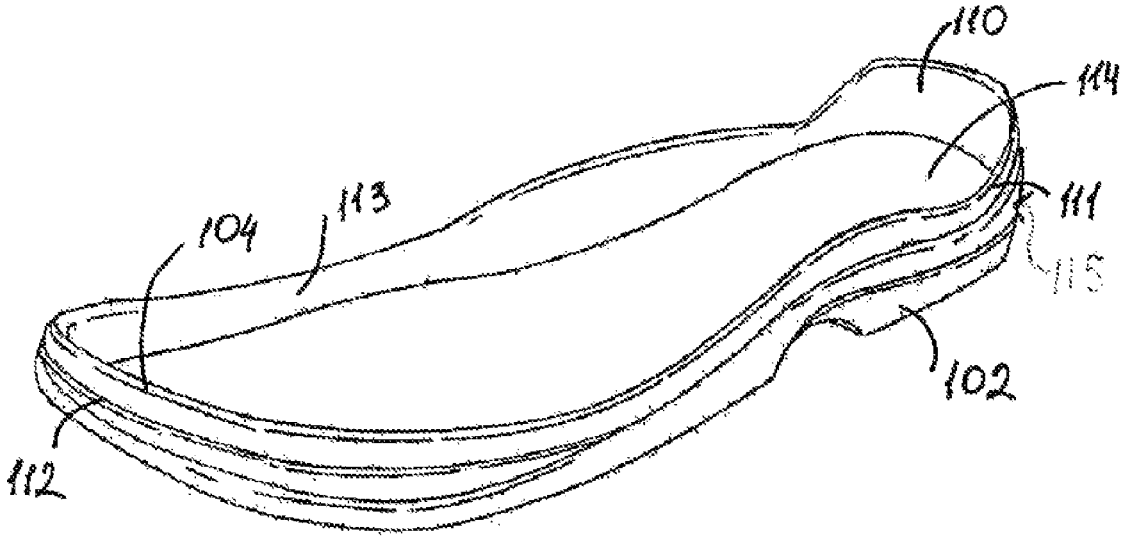
FIG. 4 is a perspective view of an outsole of the shoe shown in FIG. 3.

As shown in FIG. 4, the outsole 102 has a raised lip 104 extending along a periphery of the outsole 102. The lip 104 includes a shelf 112 formed between the lip 104 and the sidewall of the outsole 102. Preferably, a width of the shelf 112 corresponds to a thickness of the upper 101 so that when the upper 101 is stitched to the lip 104, an outside surface of the upper 101 is flush with the outside surface 115 the outsole 102. This design provides a smooth and clean appearance to the outside of the shoe. The outsole 102 is made with any suitable outsole material known in the art. For example, a molded Thermoplastic Rubber, Vulcanized Rubber, Polyurethane, etc., may be used for constructing the outsole in accordance with the present invention.

Figure 5:
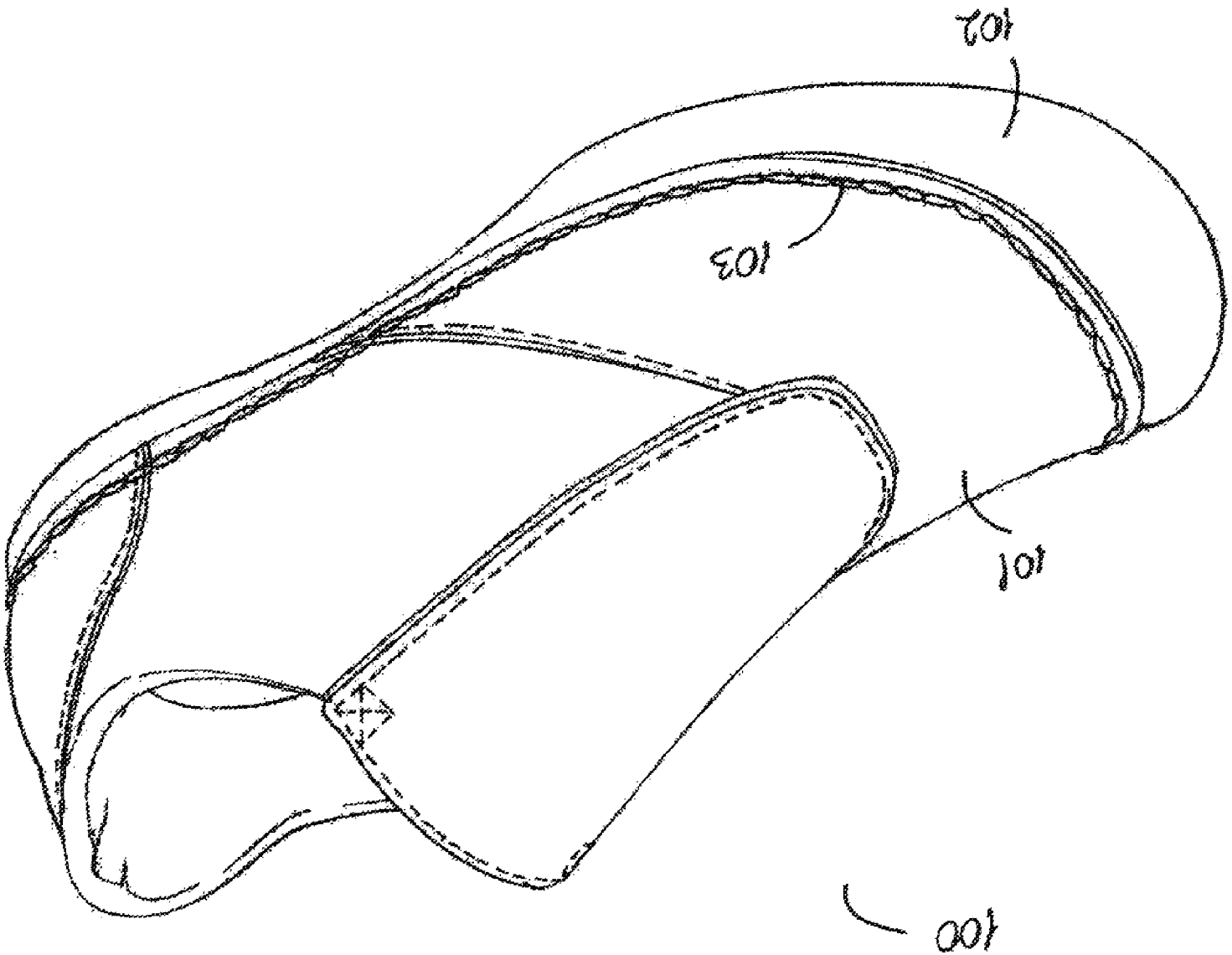
FIG. 5 is a perspective view of another embodiment of the shoe shown in FIG. 3.

The lip 104, as shown in FIG. 4, extends from the outsole in a generally vertical and upward direction. However, in other embodiments of the present invention, such as shown in FIG. 5, the sidewall of the outsole 102 is extended to cover the area of the foot above the toes. In this embodiment, the lip 104 will extend in a horizontal, rather than vertical direction in some sections of the outsole 102. Such shape of the outsole 102 is useful in protecting the shoe upper 101 from wear and tear during use and also provides extra protection to the wearer.

Preferably, the lip 104 is formed integrally with the outsole 102. However, the lip 104, in other embodiments, is a separate part that is attached to the outsole 102, for example by being sewn, glued or stapled to the outsole 102.

Figure 7:
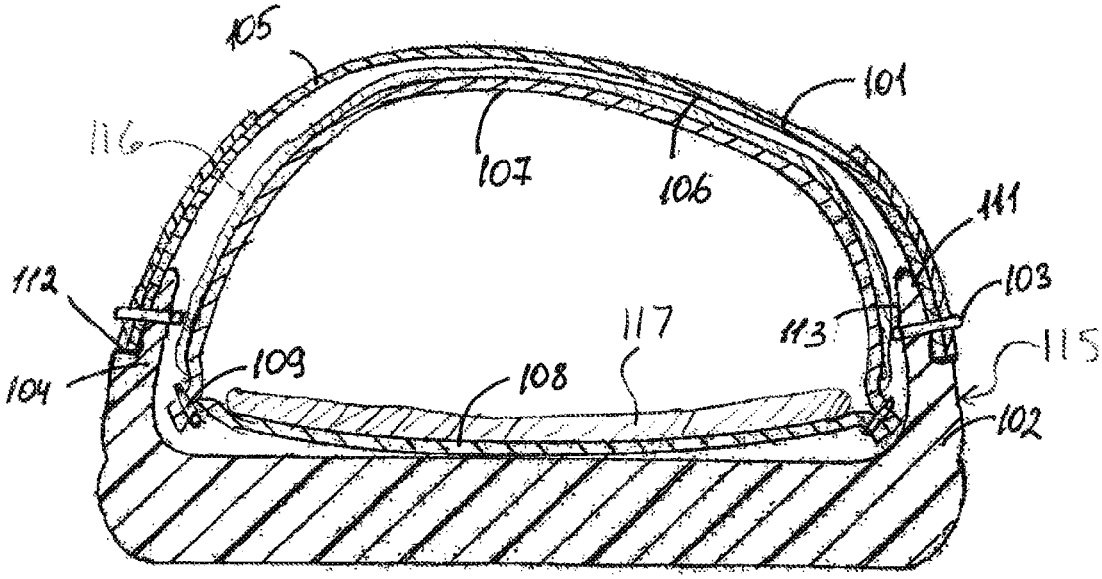
FIG. 7 illustrates a cross-sectional view of the shoe shown in FIG. 3.

As shown in FIG. 7, the upper 101 has an inside surface 106 and an outside surface 105. The upper 101 may be made with any known material that is suitable for use as a shoe upper, such as leather, fabric, rubber, polyurethane, etc. In the embodiments shown in the drawings, the upper 101 is secured to the outsole 102 by the stitch 103 along the entire periphery of the outsole 102. In other embodiments, however, the stitch 103 extends around only the toe (or "fore") area of the shoe. In still other embodiments, the stitch 103 extends back to anywhere between the toe area of the shoe and the back of the heel area of the shoe. In order to connect the upper 101 and the outsole 102 accurately, a lower edge of the upper 101 in placed on the shelf 112 such that the inside surface 106 of the upper 101 stands upright and is resting closely against an outside surface 111 of the lip 104. Sewing holes and marking lines are provided on the lip 104 and the lower edge of the upper 101 in some embodiments to assist the worker in consistently and accurately sewing the upper 101 to the lip 104. The stitch 103 extends through the outside surface 105 of the upper 101, through the inside surface 106 of the upper 101, through the outside surface 111 of the lip 104, and through the inside surface 113 of the lip 104 to the interior of the outsole, upper, and, therefore, the shoe. Thus, in accordance with the present invention, only one row of stitching 103 is visible on the outside surface of the shoe 100, which increases the aesthetic appeal of the shoe.

The stitch 103 is preferably an Opanka stitch, and most preferably a hand-sewn Opanka stitch. However, other types of stitching, such as a machine stitch, may be used in accordance with the shoe construction of the present invention. Additionally, the Opanka stitch in accordance with the present invention is generally a horizontal stitch. Any suitable stitch material, such as leather, wire, yarn, string, synthetic filaments, plastic, and the like, may be used to form the stitch 103.

In the embodiments shown in the figures, the stitch 103 is the only structure used to secure the upper 101 and the outsole 102 together. This construction reduces manufacturing costs as fewer steps are needed to complete the shoe 100. For example, without chemical bonding or cement between the upper and outsole, there is a reduction in cleanup costs and/or material savings as cement need not be purchased as is typically required with traditionally manufactured shoes. In other embodiments, other securing mechanisms may be used in conjunction with the stitch 103 which may extend only partway back from the toe area of the shoe.

Figure 6:
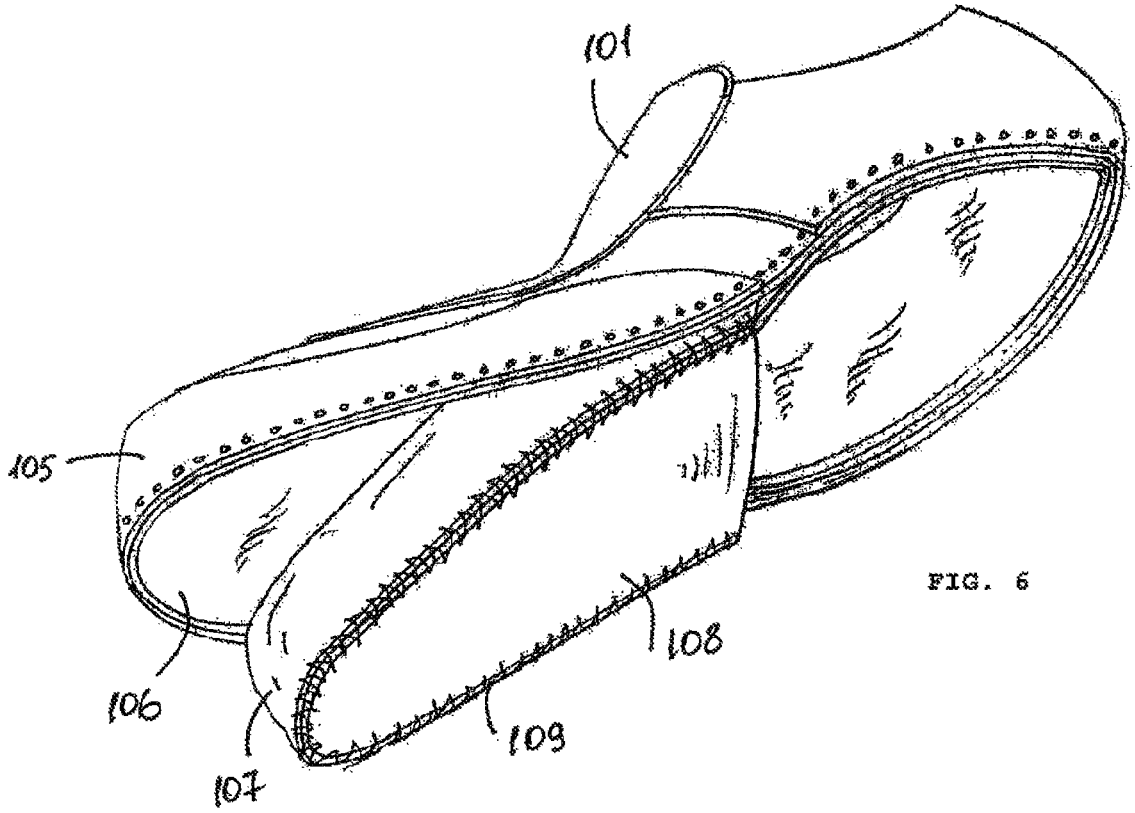
FIG. 6 is a bottom perspective view of a shoe upper of the shoe shown in FIG. 3, illustrating a vamp lining and an insole stitched to the shoe upper.

With reference to FIG. 6, the shoe 100 further includes an inner sole 108 and a vamp lining 107. The vamp lining 107 is secured to the inner sole 108 by another stitch 109. As shown in FIG. 7, the stitch 109 is placed adjacent to the inside surface 106 of the upper 101. Any suitable type of stitching may be used to connect the inner sole 108 to the vamp lining 107.

Because the sidewall of the outsole 102 including the raised lip 104 is higher than in typical shoe construction, the stitch 103 connecting the lip 104 with the upper 101 may rub against the wearer's foot and cause discomfort, most particularly in the toe area of the shoe. Therefore, the inner sole 108 and the vamp lining 107 are placed on the inside surface 106 of the upper 101 to cover the portion of stitch 103 that protrudes into the interior of the shoe and to provide protection for the wearer's foot. The inner sole 108 may cover only the fore portion of the outsole 102 or may cover the whole outsole 102.

The inner sole 108 and the vamp lining 107 are preferably moveable with respect to the upper 101 and the outsole 102 in at least the toe area of the shoe. This way, after the inner sole 108 and the attached vamp lining 107 are placed on the inside surface 106 of the upper 101, it can be moved out of the way during the stitching of the upper 101 to the outsole 102 via the stitch 103. This provides a much simpler shoe construction, requiring fewer manufacturing steps as compared with other known shoe constructions, and at the same time being free from problems associated with such known constructions.

In addition to protecting the user's foot from rubbing against the stitch 103, the inner sole 108 provides a smooth surface contacting the user's foot. Sometimes the outsole 102 and especially the top surface 114 of outsole 102 may not be smooth. The inner sole 108 helps to ease the discomfort associated with an uneven or uncomfortable surface by providing a smooth supporting surface upon which the user's foot is placed. The inner sole 108 may be made with any suitable woven or nonwoven material, such as leather, vinyl, cloth, cotton, etc. Preferably, the inner sole 108 is made of a strong material to resist wear from the outsole 102 and the user's foot.

As shown in FIG. 7, in some embodiments, the shoe 100 includes a cushion material 116 between the vamp lining 107 and the inside surface of the upper 106 to improve comfort. In the embodiment shown, the cushion layer 116 is a foam material that is adhered to the outer surface of the vamp lining 107. Alternatively, the cushion layer may be stitched to the vamp lining 107 by the stitch 109. The cushion 116 provides enhanced protection to the wearer's foot from the stitch 103, and also may alleviate any unevenness or roughness of the inside surface 106 of the upper 101. The cushion 116 will also provide insulation against cold temperatures. The cushion 116 may be made from material such as high-density polyurethane, latex foam or other suitable material that provides comfort to the wearer.

FIG. 7 also shows an insert 117 that is removably placed on the inner sole 108 for cushioning the wearer's foot. Preferably, the insert 117 is made of a cushion material to provide comfort to the wearer's foot, which is in direct physical contact with the insert 117. Thus, such insert 117 is normally made of foam, rubber, or any resilient material for providing a cushioned surface between the user's foot and the inner sole 108.

Figure 8:
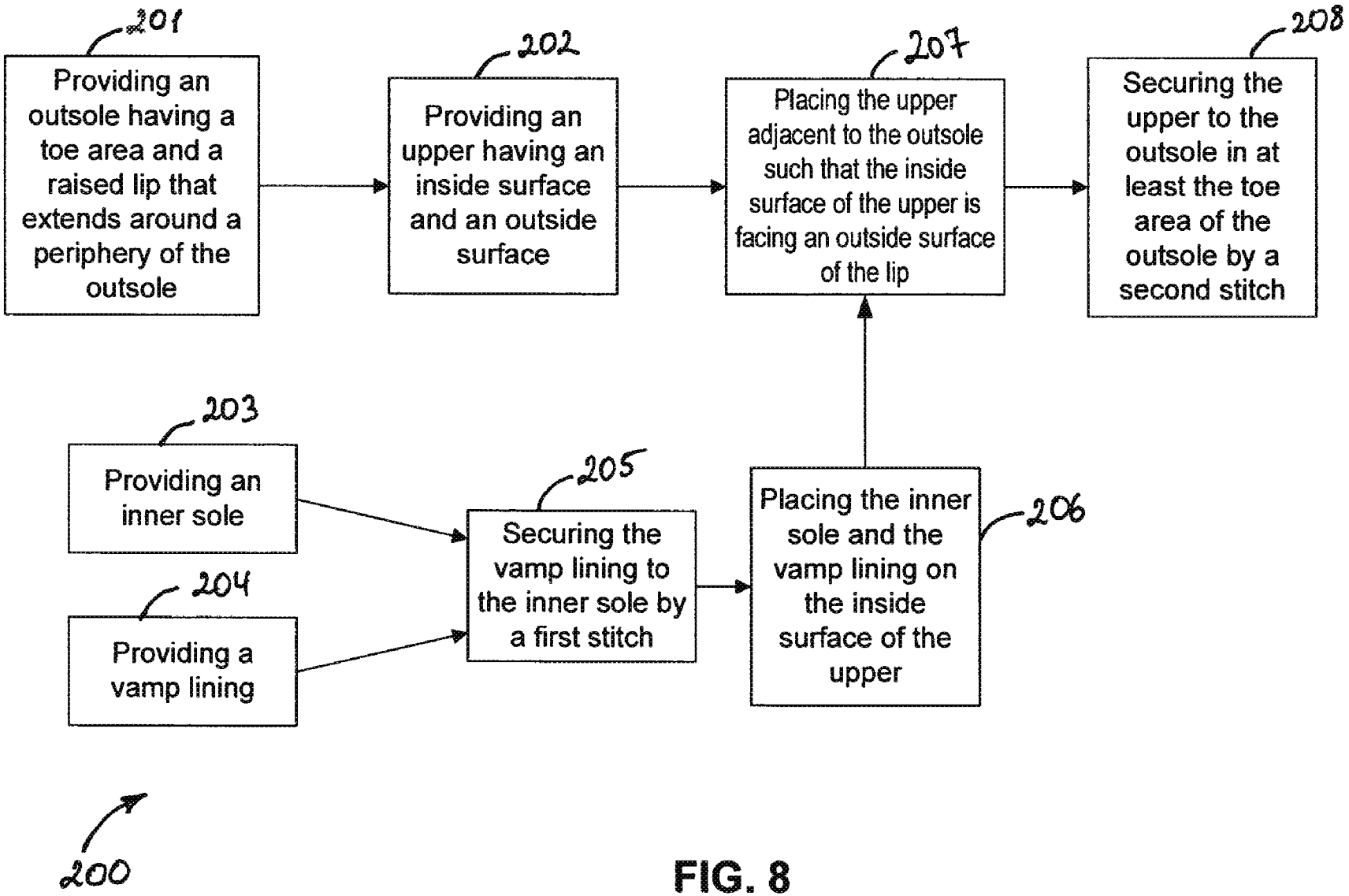
FIG. 8 illustrates a method for constructing a shoe in accordance with the present invention.

FIG. 8 illustrates a method 200 for constructing a shoe in accordance with the present invention. The method 200 includes the steps of providing 201 an outsole having a toe area and a raised lip that extends around a periphery of the outsole, providing 202 an upper having an inside surface and an outside surface, providing 203 an inner sole, providing 204 a vamp lining, and securing 205 a vamp lining to the inner sole by a first stitch. After the inner sole and the vamp lining are stitched together, the inner sole and the vamp lining are placed 206 on the inside surface of the upper. The upper is then placed 207 adjacent to the outsole such that the inside surface of the upper is facing an outside surface of the lip, and is secured 208 to the outsole in at least the toe area of the outsole by a second stitch. The inner sole attached to the vamp lining are moved out of the way during the stitching, so that when the upper stitching is complete, only the upper and outsole are sewn together, and the inner sole and the vamp lining cover the stitching to provide protection for the wearer's foot. The vamp lining and inner sole are moveable relative to the upper and the outsole in the toe area of the outsole.

The second stitch is formed by passing a stitch material through the outside surface of the upper, through the inside surface of the upper, through the outside surface of the lip, and through the inside surface of the lip.

In some embodiments, a cushion material such as a resilient foam is deposited on the outside surface of the vamp lining. The cushion may be adhered, stitched, or otherwise secured to the vamp lining.

After the stitching is complete, the shoe undergoes a simple lasting process. The shoe is first steamed to make sure the leather is moist. Then, the last is inserted. Upon completion of the lasting, a small amount of cementing may optionally be done to include a lining in the rear part and sidewalls of the shoe.

Although the invention has been described with reference to embodiments with certain constructions, structures, materials, and the like, these are not intended to exhaust all possible arrangements or features, and indeed many other modifications and variations will be ascertainable to those of skill in the art.

What is claimed is:

1. A shoe comprising:

an outsole having a toe area and a raised lip extending around a periphery of said outsole, said lip having an inside surface and an outside surface;

an upper having an inside surface and an outside surface;

an inner sole; and a vamp lining secured to said inner sole by a first stitch;

wherein said upper is secured to said outsole by a second stitch extending around at least the toe area of said outsole such that said inside surface of the upper is facing said outside surface of the lip;

wherein said second stitch extends through said outside surface of the upper, through said inside surface of the upper, through said outside surface of the lip, and through said inside surface of the lip; and wherein said inner sole and said vamp lining are adjacent to said inside surface of the upper to cover said second stitch and to provide protection for a wearer's foot.

2. The shoe according to claim 1, wherein said inner sole and said vamp lining are moveable with respect to said upper and said outsole in the toe area of the outsole.

3. The shoe according to claim 1, wherein said second stitch extends around the entire periphery of the outsole.

4. The shoe according to claim 1, wherein said inner sole covers only the toe area of the outsole.

5. The shoe according to claim 1, further comprising a shelf formed adjacent to said lip on said outside surface of said lip, wherein said shelf has a width corresponding to a thickness of said upper so that when said upper is stitched to said lip, said outside surface of the upper is substantially flush with an outside surface of said outsole.

6. The shoe according to claim 1, wherein said second stitch is an Opanka stitch.

7. The shoe according to claim 1, wherein said second stitch is a hand-sewn stitch.

8. The shoe according to claim 1, further comprising a cushion material between said vamp lining and said inside surface of the upper.

9. The shoe according to claim 1, further comprising an insert removably placed on said inner sole for cushioning the wearer's foot.

10. A method for constructing a shoe, comprising the steps of:

providing an outsole having a toe area and a raised lip that extends around a periphery of said outsole;

providing an upper having an inside surface and an outside surface;

providing an inner sole;

securing a vamp lining to the inner sole by a first stitch;

placing said upper adjacent to said outsole such that the inside surface of the upper is facing an outside surface of the lip;

securing the upper to the outsole in at least the toe area of said outsole by a second stitch, said second stitch being formed by passing a stitch material through said outside surface of the upper, through said inside surface of the upper, through said outside surface of the lip, and through said inside surface of the lip; and placing said inner sole and said vamp lining adjacent to the inside surface of the upper such that said inner sole and said vamp lining cover said second stitch and provide protection for a wearer's foot.

11. The method for constructing a shoe according to claim 10, wherein said inner sole and said vamp lining are moveable with respect to the upper and the outsole in the toe area of the outsole.

12. The method for constructing a shoe according to claim 10, further comprising the step of providing a cushion material between said vamp lining and said inside surface of the upper.

13. The method for constructing a shoe according to claim 10, further comprising the step of providing an insert removably placed on said inner sole for cushioning the wearer's foot.

14. The method for constructing a shoe according to claim 10, wherein the upper is secured to the outsole by an Opanka stitch.

15. The method for constructing a shoe according to claim 10, wherein the upper is secured to the outsole by a hand-sewn stitch.

16. The method for constructing a shoe according to claim 10, wherein said inner sole is provided only in the toe area of the outsole.

17. The method for constructing a shoe according to claim 10, further comprising the step of providing a shelf on said outside surface of said lip and said shelf having a width corresponding to a thickness of said upper.

18. The method for constructing a shoe according to claim 17, further comprising the step of stitching said upper to said lip such that said outside surface of the upper is substantially flush with an outside surface of said outsole.

* * * * *